US012685430B2

(12) United States Patent
Kremmel et al.

(10) Patent No.: US 12,685,430 B2
(45) Date of Patent: Jul. 21, 2026

(54) RETENTION CLIP FOR A CARRIER ROLLER ASSEMBLY

(71) Applicant: Haier US Appliance Solutions, Inc., Wilmington, DE (US)

(72) Inventors: Aldo Vincent Kremmel, Palmyra, IN (US); Zachary Wiles, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/774,037

(22) Filed: Jul. 16, 2024

(65) Prior Publication Data

US 2026/0020742 A1 Jan. 22, 2026

(51) Int. Cl.
*A47L 15/50* (2006.01)

(52) U.S. Cl.
CPC ..... *A47L 15/507* (2013.01); *A47L 15/50* (2013.01)

(58) Field of Classification Search
CPC ..... A47L 15/507; A47L 15/50
See application file for complete search history.

(56) References Cited

U.S. PATENT DOCUMENTS

| | | | | |
|---|---|---|---|---|
| 5,474,378 | A * | 12/1995 | Smith | A47L 15/507 D15/19 |
| 9,526,399 | B2 | 12/2016 | Garnett et al. | |
| 10,136,795 | B2 | 11/2018 | Nowell, Jr. et al. | |
| 10,772,481 | B2 | 9/2020 | Agrawal et al. | |
| 2009/0151758 | A1 | 6/2009 | Kristensson et al. | |
| 2013/0300270 | A1* | 11/2013 | Garnett | A47L 15/507 384/58 |
| 2015/0164301 | A1* | 6/2015 | Bartloff | A47B 95/043 211/41.8 |
| 2019/0254499 | A1* | 8/2019 | Agrawal | A47L 15/507 |

OTHER PUBLICATIONS

Arcady Genkin, "3D Printed C-Clip for Top Shelf Roller for Miele Dishwashers", Published Aug. 20, 2023, accessed https://arcady.genkin.ca/2023/08/3d-printed-c-clip-for-top-shelf-roller-for-miele-dishwashers/ on Jul. 26, 2024, 6 pages.

* cited by examiner

*Primary Examiner* — Kimberley S Wright
(74) *Attorney, Agent, or Firm* — Dority & Manning, P.A.

(57) ABSTRACT

A dishwasher appliance includes a carrier roller assembly for supporting a rack within a wash chamber. The carrier roller assembly includes a carrier body defining a receiving slot for receiving a wire of the rack. A retention clip is operably positioned within receiving slot adjacent to the wire of the rack. The retention clip includes a first end operably engaged with the wire, the first end being rigid, and a second end opposite the first end, the second end being depressible. The second end depresses to permit the retention clip to be inserted into the receiving slot.

12 Claims, 6 Drawing Sheets

RETENTION CLIP FOR A CARRIER ROLLER ASSEMBLY

FIELD OF THE INVENTION

The present disclosure relates generally to dishwasher appliances, and more particularly to carrier roller assemblies for supporting the racks of dishwasher appliances.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a pump may periodically discharge soiled wash fluid that collects in the sump space and the process may be repeated.

Conventional dishwasher appliances include slide assemblies for supporting one or more upper racks within the wash chamber. These slide assemblies permit a user to slide the upper racks out of the wash chamber for emptying and loading dishes and back into the wash chamber for running a wash cycle. Similarly, typical racks are slidable into and out of the wash chamber between cycles for removing and loading dishes, but rely on roller assemblies to achieve such movement. Particularly, carrier roller assemblies are typically mounted to the rack and include a plurality of rollers that roll along the dishwasher door which opens to a horizontal position. Notably, however, conventional carrier roller assemblies may not be permanently fixed with the rack and tend to fall off after continued use.

Accordingly, an appliance that utilizes an improved carrier roller assembly would be useful. More specifically, an insert for a carrier roller assembly that is simple to assemble, versatile, and may be universally used with different carrier roller assemblies in different model dishwashers would be particularly beneficial.

BRIEF DESCRIPTION OF THE INVENTION

The present subject matter provides a dishwasher appliance including a carrier roller assembly for supporting a rack within a wash chamber. The carrier roller assembly includes a carrier body defining a receiving slot for receiving a wire of the rack. A first and a second prong extend from the carrier body into the receiving slot for securely locking the wire in position after it is fully inserted into the receiving slot. The first prong and the second clip are different sizes for snapping around and securing wires having different diameters such that the carrier roller assembly is versatile and may be universally used with dishwasher appliances using differing wire sizes. Additional aspects and advantages of the invention will be set forth in part in the following description, may be apparent from the description, or may be learned through practice of the invention.

In accordance with one exemplary embodiment of the present disclosure, a dishwasher includes a carrier roller assembly for supporting a rack within a wash chamber. The carrier roller assembly includes a carrier body defining a receiving slot for receiving a wire of the rack. An retention clip is operably positioned within receiving slot adjacent to the wire of the rack. The retention clip includes a first end operably engaged with the wire, the first end being rigid, and a second end opposite the first end, the second end being depressible. The second end depresses to permit the retention clip to be inserted into the receiving slot.

In accordance with another exemplary embodiment of the present disclosure, a retention clip for a carrier roller assembly that supports a rack within a wash chamber of a dishwasher appliance. The carrier roller assembly includes a carrier body mounted to the rack. The carrier body defines a receiving slot for receiving a wire of the rack, the receiving slot is defined in part by a first wall. The retention clip includes a first end positioned within the receiving slot proximal the wire, the first end is rigid. The retention clips includes a second end coupled with the first end. The second end is resilient, and the second end deflects to permit the retention clip to insert within the receiving slot. The retention clip includes a first lateral stabilizer coupled with the first end and the second end. The retention clip further includes a transverse stabilizer coupled with the first end and the second end. The transverse stabilizer bisects the first end and the second end.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
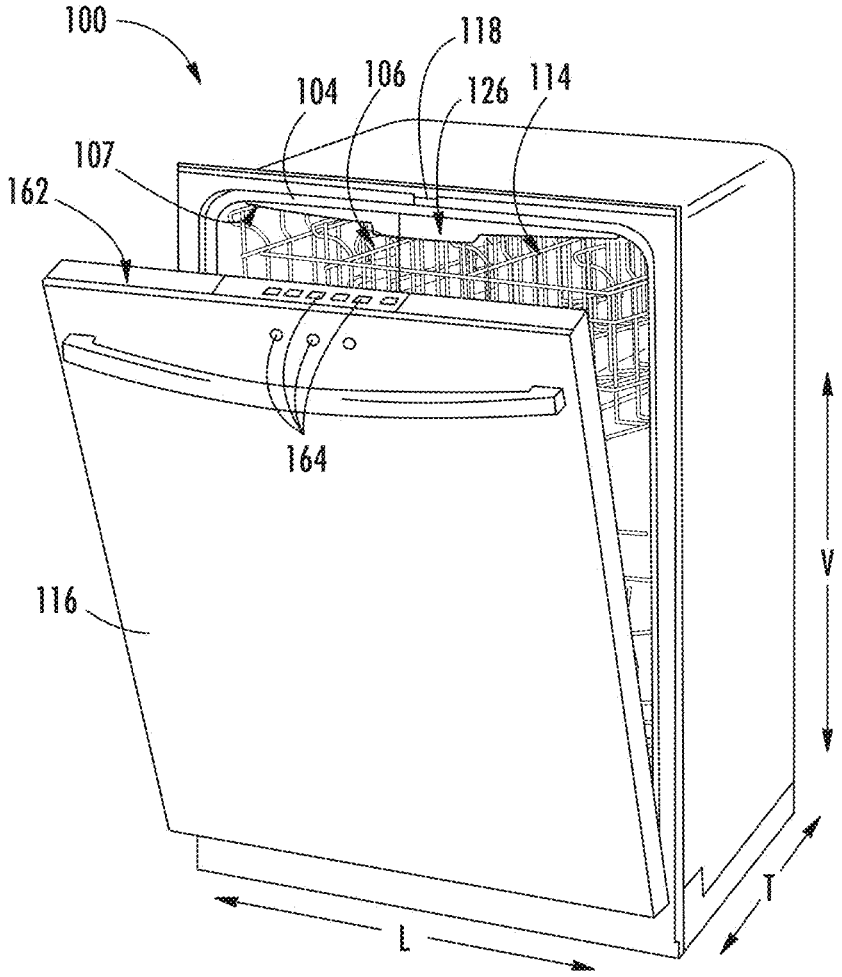
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
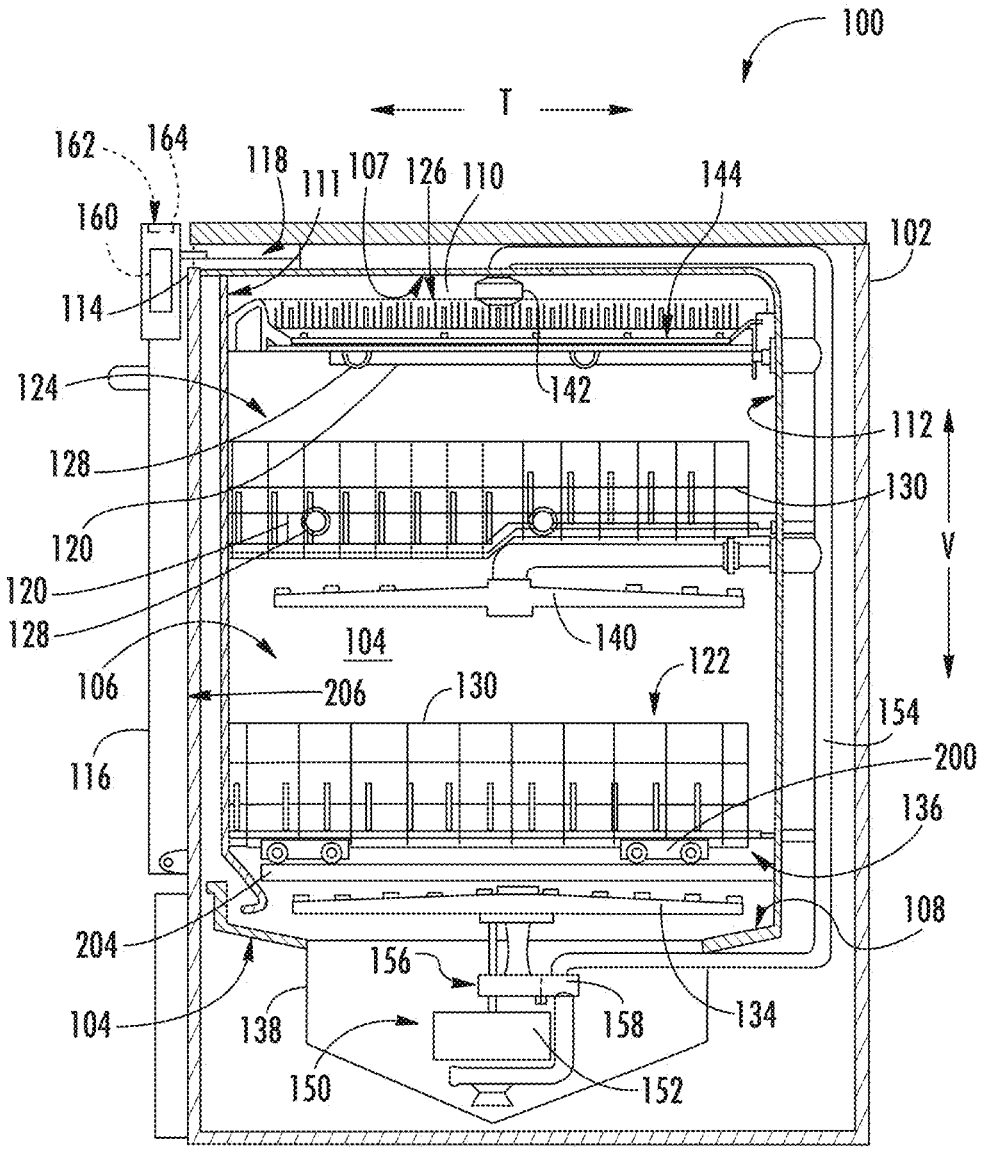
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, a lower rack assembly 122, a middle rack assembly 124, and an upper rack assembly 126 are stacked along the vertical direction V within wash chamber 106. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. With respect to middle rack assembly 124 and upper rack assembly 126, this is facilitated, for example, by guide rails 120 which are mounted to side walls 110 and rollers 128 mounted onto rack assemblies 124, 126, respectively. In addition, as will be described in more detail below, lower rack assembly 122 (or any other rack assembly) may include a plurality of carrier roller assemblies 200 which slidably support lower rack assembly 122, thereby permitting the lower rack to roll out of wash chamber 106 and rest on door 116 when it is in the open (i.e., horizontal) position. Although a guide rails 120, rollers 128, and carrier roller assemblies 200 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Referring now generally to FIGS. 3 through 6, a lower rack and carrier roller assembly 200 will be described according to an example embodiment of the present subject matter. Carrier roller assembly 200 may be used as shown in FIG. 2 for supporting lower rack assembly 122. Carrier roller assembly 200 is generally configured for providing vertical support to a lower rack 202, which may be equivalent to lower rack assembly 122. A retention clip 300 is inserted into the carrier roller assembly 200. The retention clip 300 is generally configured for providing stabilization between the carrier roller assembly 200 and the lower rack assembly 122. In addition, as shown in the exemplary embodiment illustrated in FIG. 2, tub 104 of dishwasher 100 may define lower guide rails 204 and door 116 may define a lower rack rolling surface 206. In this manner, when door 116 is in the open position such that it extends substantially within a horizontal plane, carrier roller assembly 200 may permit lower rack 202 slide out of wash chamber 106 along the transverse direction T and rest on door 116 for loading and unloading dishes. Although carrier roller assembly 200 is illustrated as being used to support lower rack 202, it should be appreciated that carrier roller assembly 200 and the retention clip 300 may be used with any suitable dishwasher rack.

Figure 3:
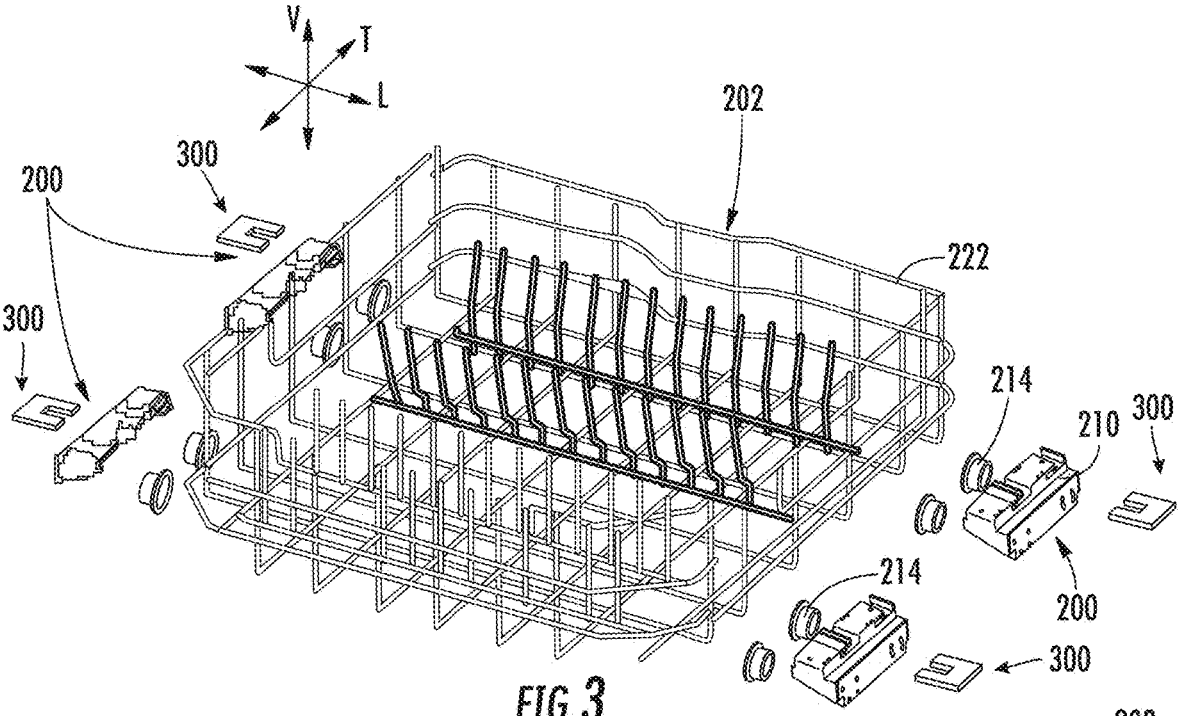
FIG. 3 provides an exploded view of a lower rack, carrier roller assemblies, and retention clips according to an example embodiment of the present subject matter.

As best shown in FIG. 3, lower rack 202 may be supported by four carrier roller assemblies 200, and thus four retention clips 300. In this regard, two carrier roller assemblies 200 and two retention clips 300 may be positioned on each lateral side of lower rack 202. Moreover, as described below, carrier roller assemblies 200 and the retention clips 300 are designed to be interchangeably used on either the left side or the right side of lower rack 202. In this manner, a single set of molds may be used to form the left and right side carrier roller assemblies 200 and the left and right side retention clips 300, thereby reducing manufacturing costs and complexity. Notably, when the retention clip 300 is inserted into the carrier roller assembly 200, which is installed onto lower rack 202, the retention clip 300 and the carrier roller assembly 200 share a coordinate system with dishwasher 100. Therefore, the retention clip 300 will be described in herein as sharing the vertical direction V, the lateral direction L, and the transverse direction T with dishwasher 100.

Figure 4:
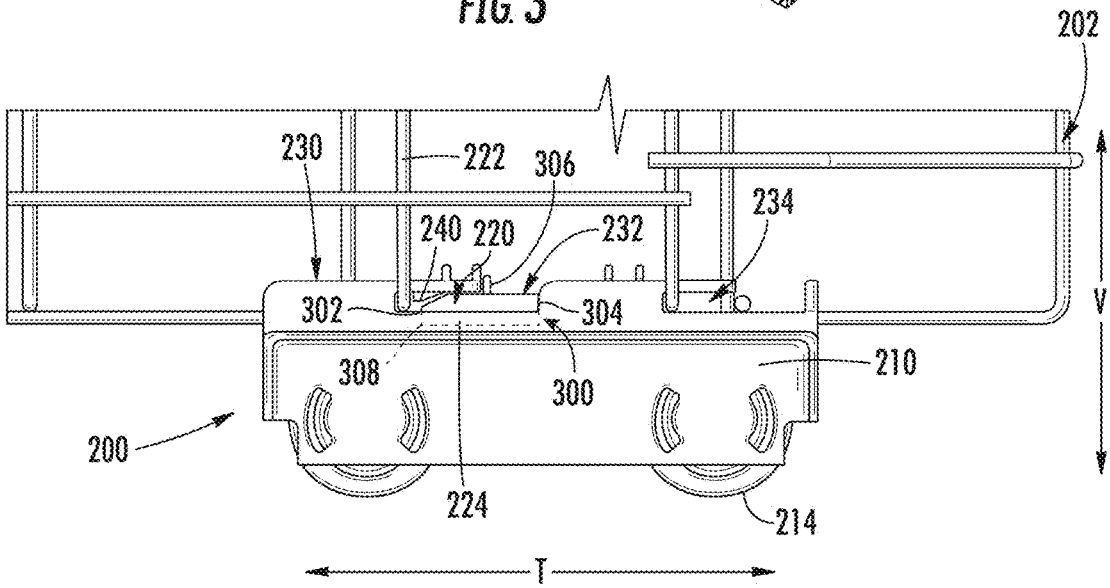
FIG. 4 provides a side view of the exemplary retention clip within the carrier roller assembly of FIG. 3 according to an example embodiment of the present subject matter.
Figure 5:
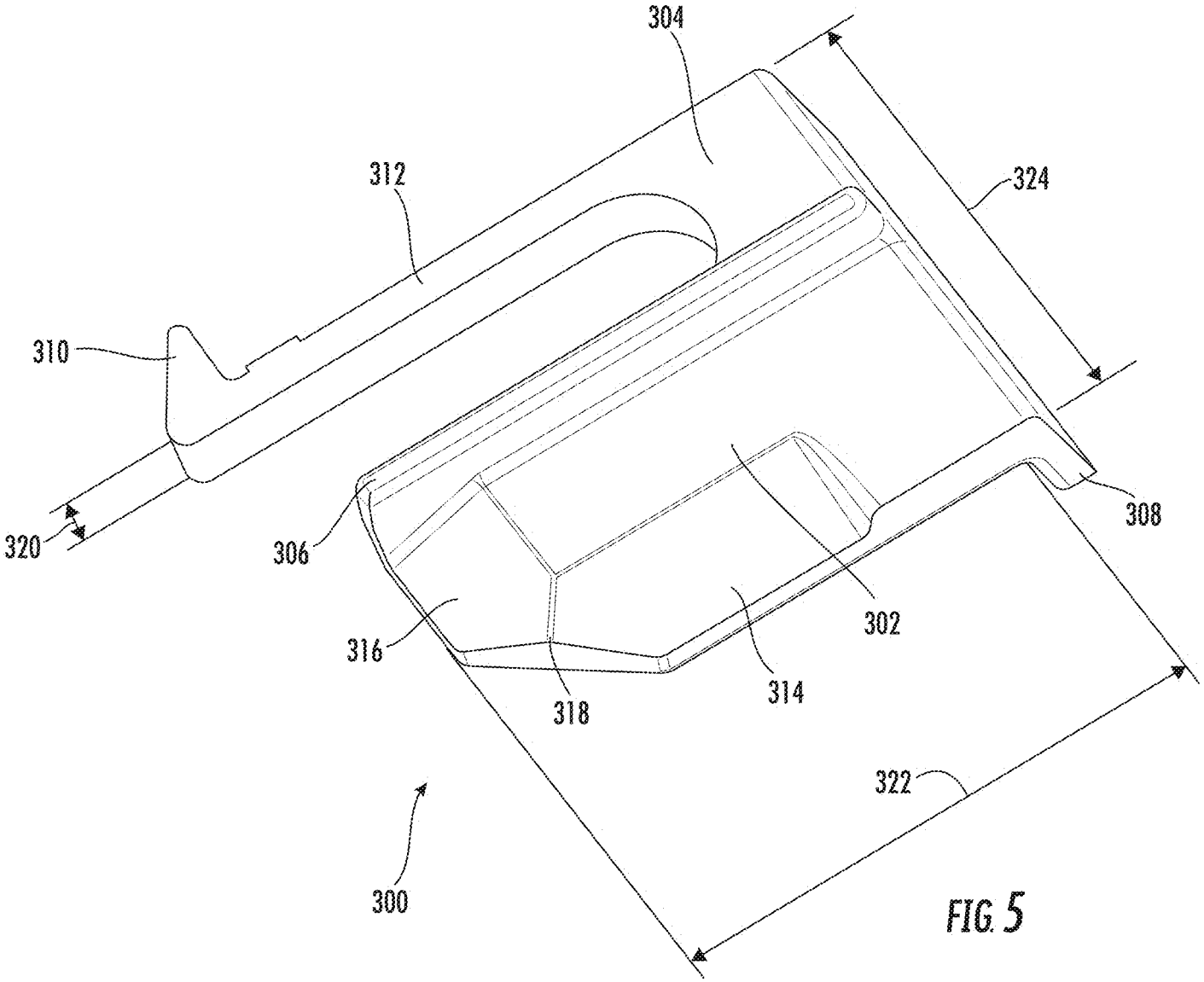
FIG. 5 provides a perspective view of the retention clip of FIG. 3 according to an example embodiment of the present subject matter.
Figure 6:
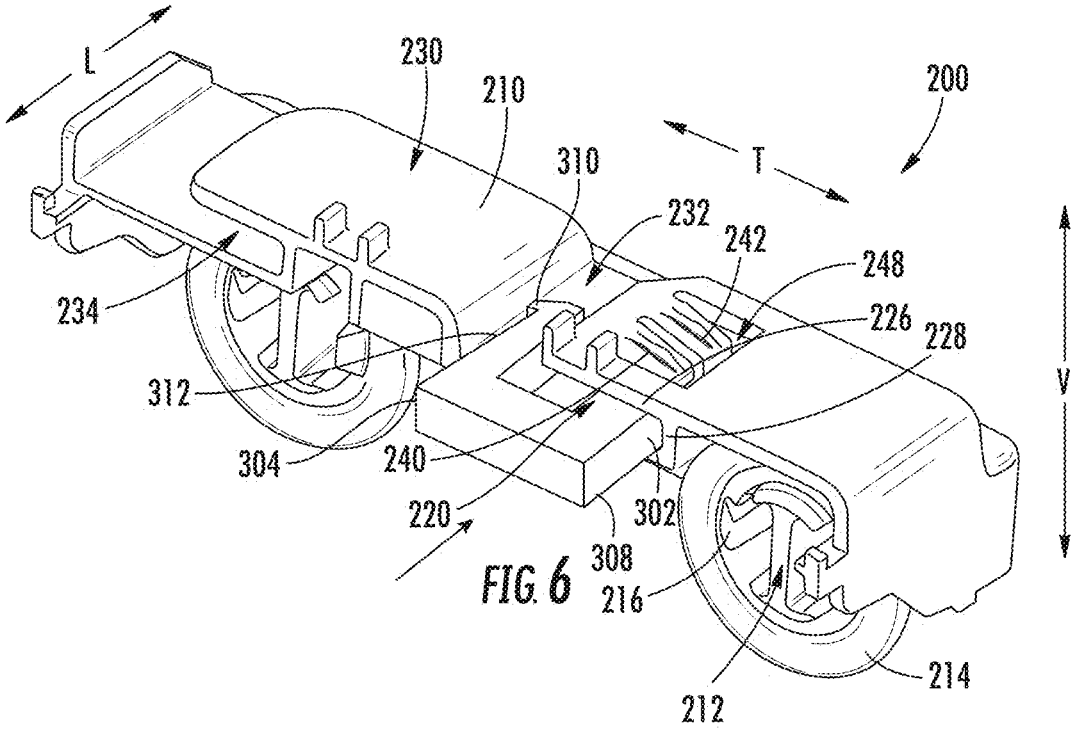
FIG. 6 provides a perspective view of the exemplary retention clip being inserted into the carrier roller assembly of FIG. 3 according to an example embodiment of the present subject matter.

Referring now to FIGS. 4 through 6, carrier roller assembly 200 includes a carrier body 210 that is mounted to lower rack 202. The carrier body 210 may define a plurality of roller mounts 212. More specifically, according to the illustrated embodiment, carrier body 210 may define two roller mounts 212 that are spaced apart along the transverse direction T and extend along the lateral direction L. Carrier roller assembly 200 may further include a plurality of rollers 214 that are rotatably mounted onto the plurality of roller mounts 212. In this regard, rollers 214 may define a cylindrical channel that is received over roller mounts 212 may be secured in place using a pin or another latching feature, such as a resilient clip 216. Therefore, when rollers 214 are mounted onto roller mounts 212, and when carrier body 210 is fixed to lower rack 202, lower rack 202 may roll into and out of wash chamber 106, e.g., along lower guide rails 204 and lower rack rolling surface 206.

As illustrated, carrier body 210 also defines a receiving slot 220 that is generally configured for receiving a wire 222 of lower rack 202. Additionally, the receiving slot 220 is further configured for receiving the retention clip 300. More specifically, receiving slot 220 extends through carrier body 210 and is defined at least in part by a top surface 230, a first wall 224, a second wall 226, and an end wall 228. In general, carrier roller assembly 200 is mounted on lower rack 202 by sliding carrier body 210 onto lower rack 202 such that wire 222 is received within receiving slot 220. As illustrated, the retention clip 300 is inserted into the receiving slot 220 by translating the retention clip 300 along the lateral direction L. Additionally, or alternatively, the retention clip 300 may be inserted into the receiving slot 220 by translation along the transverse direction T, translation along the vertical direction V, rotation about a transverse axis, rotation about a lateral axis, rotation about a vertical axis, or a combination thereof.

According to the illustrated embodiment, receiving slot 220 is partially defined by the top surface 230 of carrier body 210. More specifically, receiving slot 220 extends from an entry 232 defined in top surface 230 and extends at least partially within the horizontal plane (i.e., as defined by the lateral direction L and transverse direction T) within carrier body 210.

The retention clip 300 includes a first end 302 inserted into the receiving slot 220. The retention clip 300 further includes a second end 304 coupled with the first end 302. The second end 304 is opposite the first end 302 along the transverse direction T. The retention clip 300 further includes a transverse stabilizer 306 that may be referred to as a flange. The transverse stabilizer 306 is coupled with the first end 302 and the second end 304. The transverse stabilizer 306 may bisect, or denote, the first end 302 from the second end 304 of the retention clip 300. Additionally, or alternatively, the transverse stabilizer 306 may extend vertically upward from the first end 302 and the second end 304. The retention clip 300 further includes a first lateral stabilizer 308 coupled with the first end 302 and the second end 304. The first lateral stabilizer 308 may be referred to as a shoulder. The first lateral stabilizer 308 may extend vertically downward from the first end 302 and the second end 304. The transverse stabilizer 306 and the first lateral stabilizer 308 are described in greater detail below.

In order to further stabilize carrier roller assembly 200, carrier body 210 may further define a secondary slot 234 that is spaced apart from receiving slot 220 along the transverse direction T. Secondary slot 234 may have the same or a similar shape to receiving slot 220 and may be configured for receiving another wire 222 of lower rack 202, e.g., such as an adjacent wire 222 along the transverse direction T.

The various components of the retention clip 300 may be formed from any suitable material and in any suitable manner. For example, according to an exemplary embodiment, the retention clip 300 is injection molded as a single piece using a suitably rigid plastic material. Similarly, the carrier roller assembly 200 may be made via injection mold from plastic. The rigid plastic material of the retention clip 300 and/or the carrier roller assembly 200 may snap together. Notably, such a construction reduces the number of parts necessary to assemble lower rack assembly 122 thereby reducing manufacturing time, costs, and complexity.

In order to secure carrier roller assembly 200 onto lower rack 202, carrier body 210 may define various features for locking lower rack 202, or more specifically wires 222, into carrier body 210. More specifically, according to an exemplary embodiment, carrier roller assembly 200 includes a first prong 240 and a second prong 242 that extend from carrier body 210 into receiving slot 220. In general, prongs 240, 242 are resilient members configured for engaging and locking wire 222 in position at a bottom of receiving slot 220, i.e., where wire 222 is contacting end wall 228.

According to the illustrated embodiment, first prong 240 and second prong 242 are each flexible arms have a fixed end 244 positioned proximate entry 232 of receiving slot 220 and a distal end 246 that extends toward end wall 228 in a cantilevered manner. More specifically, an aperture 248 is defined through top surface 230 of carrier body 210 (i.e., through second wall 226). Prongs 240, 242 extend from carrier body within aperture 248 and protrude down into receiving slot 220. In this manner, prongs 240, 242 may deflect when wire 222 is pressed into receiving slot 220 until wire 222 clears prongs 240, 242 which may then snap back into a relaxed position for preventing the subsequent removal of wire 222 from receiving slot 220.

Referring now to FIG. 5, the retention clip 300 may have a first sloped surface 314 defined by the first end 302. The first sloped surface 314, as illustrated in the exemplary embodiment, is sloped such that a thickness 320 of the retention clip 300 decreases as the first sloped surface 314 slopes away from the second end 304. The retention clip 300 may have a second sloped surface 316 defined by the first end 302. The second sloped surface 316, as illustrated in the exemplary embodiment, is sloped such that a thickness 320 of the retention clip 300 decreases as the second sloped surface 314 slopes away from the first lateral stabilizer 308. The second sloped surface 316, as illustrated, may intersect the first sloped surface 314. A width 322 of the retention clip 300 is substantially equal to a transverse distance between the top surface 230 and the end wall 228.

The retention clip 300 may have a truncated corner 318. The truncated corner 318, as illustrated, may be located where the first sloped surface 314 intersects the second sloped surface 316. The truncated corner 318 may be prismatic, as illustrated. Alternatively, the truncated corner 318 may be rounded. Advantageously, the first sloped surface 314, the second sloped surface 316, and the truncated corner 318 may permit for easier insertion of the retention clip 300 into the receiving slot 220.

With further reference to FIGS. 5 through 8, the retention clip 300 may include a cantilevered arm 312 coupled with the second end 304. The cantilevered arm 312, as illustrated in the exemplary embodiments, may extend laterally away from the first lateral stabilizer 308. The thickness 320 of the retention clip 300 may be generally constant across the retention clip 300, except for at the first sloped surface 314 and the second sloped surface 316.

The retention clip 300 includes a second lateral stabilizer 310 coupled with the cantilevered arm 312. The second lateral stabilizer 310, as illustrated, may comprise a barb. Additionally, or alternatively, the second lateral stabilizer 310 may comprise any similar protrusion extending transversely from the cantilevered arm 312.

Figure 7:
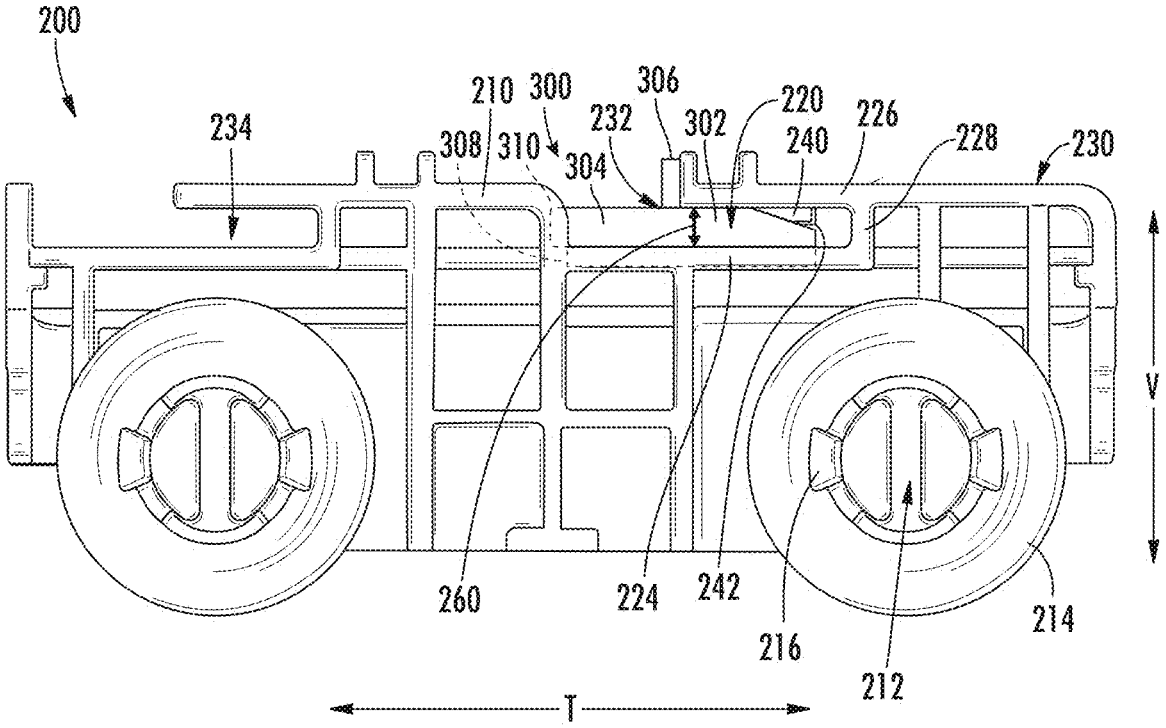
FIG. 7 provides a side view of the exemplary retention clip inserted into the carrier roller assembly FIG. 3 according to an exemplary embodiment of the subject matter.

Referring now specifically to FIG. 6 through 7, an example embodiment of the retention clip 300 is being inserted translatably and laterally into the receiving slot 220. The cantilevered arm 312 deflects until the second lateral stabilizer 310 is outside of the receiving slot 220. The cantilevered arm 312 rebounds, as shown in FIG. 5, once the second lateral stabilizer 310 is outside of the receiving slot 220. The first lateral stabilizer 310 and the cantilevered arm 312 engaged the top surface within the receiving slot 220 if the retention clip 300 is fully inserted within the receiving slot 220. When the retention clip 300 is fully inserted in the receiving slot 220, the first lateral stabilizer 310 extends transversely past the top surface 230 away from the cantilevered arm 312, as illustrated in FIG. 7.

Figure 8:
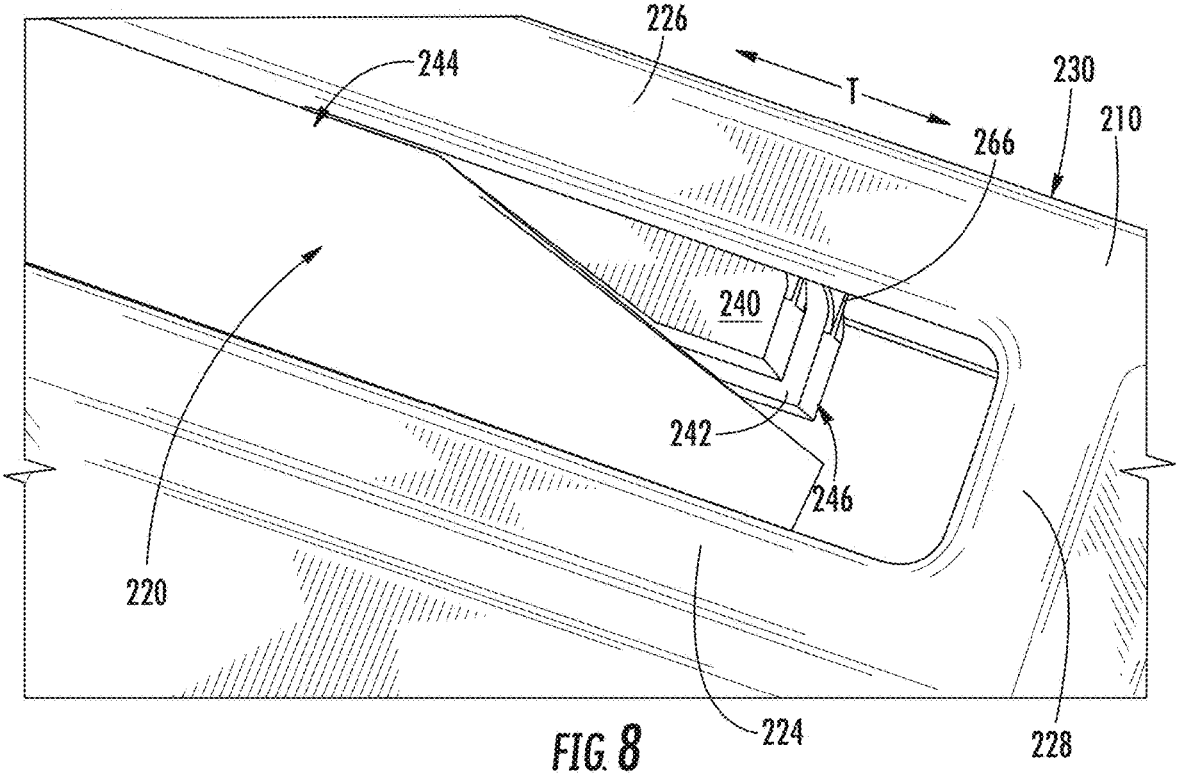
FIG. 8 provides another close-up view of the exemplary retention clip inserted within the carrier roller assembly of FIG. 3 according to an exemplary embodiment of the subject matter.

As best shown in FIG. 8, receiving slot 220 further defines a slot height 260 between the first wall 224 and the second wall 226 along the vertical direction V. The slot height 260 is substantially equal to the thickness 320 of the retention clip 300. In addition, prongs 240, 242 both extend into receiving slot 220 along the vertical direction V. The prongs 240, 242 are sloped vertically downward along the transverse direction T. The sloped profile of the prong 240, 242, as illustrated, may be complementary of the slope of the first surface 314. The first surface 314 of the retention clip 300 may engage the prongs 240, 242 to provide support to the prongs 240, 242 to keep the carrier roller assembly 200 attached to the wire 222 (shown in FIG. 4).

It should be appreciated that prongs 240, 242 and receiving slot 220 are described above according to an exemplary embodiment to explain aspects of the present subject matter. It should be appreciated that the size and geometry of these features may be changed according to alternative embodiments. For example, the size, resiliency, and geometry of the retention clip 300 and the prongs 240, 242 may be altered to accommodate wires 222 having different sizes. In addition, the lengths of prongs 240, 242 and the first surface 314 may be altered depending on the resiliency of prongs 240, 242 and the size of wire 222. According to still another embodiment, each prong may define a stiffening rib 266 that extends along the transverse direction T on each clip to provide additional rigidity. Other configurations of prongs 240, 242 are possible and within the scope of the present subject matter.

By defining carrier body 210, prongs 240, 242, and retention clip 300 as described above, the retention clip 300 may be used in carrier roller assembly 200 of dishwasher appliances having lower racks formed from different types of wire. In this regard, for example, a typical wire 222 that is formed from polyvinyl chloride (PVC) may have a maximum diameter of approximately 0.18 inches. By contrast, a typical wire 222 that is formed from nylon may have a maximum diameter of approximately 0.17 inches. According to alternative embodiments, typical wire 222 may have any other suitable size, such as between 0.15 and 0.19 inches. As described above, carrier body 210 defines two prongs 240, 242 which may be used for mounting carrier roller assembly 200 to lower racks formed from wires having two different diameters. However, it should be appreciated that according to alternative embodiments, carrier body 210 may define any suitable number prongs for securing any suitable size wire 222 in conjunction with the retention clip 300, being constructed of any material and having any suitable type and thickness of coating.

As explained herein, aspects of the present subject matter are generally directed to a clip that secures the wheel carrier to the lower rack of a dishwasher. Specifically, the clip may snap onto the carrier in a direction different from the carrier's installation snap, adding robustness to prevent bi-directional motion. Additionally, the component creates an added robustness of a second mechanical force resisting lock by trapping the wire if the primary installation snap fails.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical, a lateral, and a transverse direction, the dishwasher appliance comprising:

a wash tub that defines a wash chamber for receipt of articles for washing;

a rack slidably positioned within the wash chamber and configured for movement along the transverse direction;

a door rotatably mounted to the wash tub for providing selective access to the wash chamber;

a carrier roller assembly for supporting the rack, the carrier roller assembly comprising:

a carrier body mounted to the rack, the carrier body defining a receiving slot for receiving a wire of the rack, the receiving slot being defined in part by a first wall;

a first prong extending from the carrier body into the receiving slot, the first prong having a first sloped profile complementary of a first surface of a first end of a retention clip; and a second prong extending from the carrier body into the receiving slot, the second prong having a second sloped profile complementary of the first surface of the first end; and the retention clip operably positioned within receiving slot adjacent to the wire of the rack, the retention clip comprising:

the first end operably positioned proximal the wire, the first end being rigid, wherein the first end of the retention clip comprises the first surface, and wherein the first surface is sloped toward the wire; and a second end opposite the first end, the second end being resilient, wherein the second end deflects to permit the retention clip to be inserted into the receiving slot, and wherein the second end rebounds to retain the retention clip within the receiving slot.

2. The dishwasher appliance of claim 1, wherein a thickness of the retention clip is substantially equal to a height of the slot.

3. The dishwasher appliance of claim 1, wherein the receiving slot is defined in part by an end wall and top surface, and wherein a width of the retention clip is substantially equal to a transverse distance between the top surface and the end wall.

4. The dishwasher appliance of claim 3, wherein the second end of the retention clip comprises:

a cantilevered arm; and a barb coupled with the cantilevered arm.

5. The dishwasher appliance of claim 4, wherein the cantilevered arm and the barb engage the top surface to at least partially laterally stabilize the retention clip within the receiving slot.

6. The dishwasher appliance of claim 1, wherein the first end of the retention clip further comprises a second surface non-parallel to the first surface, wherein the second surface is sloped.

7. The dishwasher appliance of claim 1, wherein the retention clip further comprises a flange comprising:

a first side coupled with the first end; and a second side coupled with the second end.

8. The dishwasher appliance of claim 7, wherein the flange engages the carrier body, and wherein the flange at least partially transversely stabilizes the retention clip within the receiving slot.

9. The dishwasher appliance of claim 1, wherein the retention clip further comprises a shoulder coupled with the first end and the second end, wherein the shoulder engages the first wall, and wherein the shoulder at least partially laterally stabilizes the retention clip within the receiving slot.

10. The dishwasher appliance of claim 1, wherein the first end of the retention clip inserted into the receiving slot operably engages the wire.

11. The dishwasher appliance of claim 1, wherein the first end of the retention clip includes a truncated corner.

12. A dishwasher appliance defining a vertical, a lateral, and a transverse direction, the dishwasher appliance comprising:

a wash tub that defines a wash chamber;

a rack slidably positioned within the wash chamber;

a carrier roller assembly for supporting the rack, the carrier roller assembly comprising:

a carrier body mounted to the rack, the carrier body defining a receiving slot for receiving a wire of the rack, the receiving slot being defined in part by a first wall;

a first prong extending from the carrier body into the receiving slot; and a second prong extending from the carrier body into the receiving slot; and a retention clip operably positioned within receiving slot adjacent to the wire of the rack, the retention clip comprising:

a first end operably positioned proximal the wire, the first end being rigid; and a second end opposite the first end, the second end being resilient, wherein the second end deflects to permit the retention clip to be inserted into the receiving slot, and wherein the second end rebounds to retain the retention clip within the receiving slot.

* * * * *